US011738221B2

(12) United States Patent
Konukoglu et al.

(10) Patent No.: US 11,738,221 B2
(45) Date of Patent: Aug. 29, 2023

(54) RESPIRATORY MASK AND METHOD OF PRODUCTION

(71) Applicant: Sanko Tekstil Isletmeleri San. Ve Tic. A.S., Inegol-Bursa (TR)

(72) Inventors: Fatih Konukoglu, Inegol-Bursa (TR); Kenan Loyan, Inegol-Bursa (TR); Esref Tuncer, Inegol-Bursa (TR); Ahmet Ozkan, Inegol-Bursa (TR); Mahmut Ozdemir, Inegol-Bursa (TR); Erdogan Baris Ozden, Inegol-Bursa (TR); Esin Kalfa Kilickan, Inegol-Bursa (TR); Omer Yilmaz, Inegol-Bursa (TR)

(73) Assignee: SANKO TEKSTIL ISLETHELERI SAN. VETIC. A.S., Inegol-Bursa (TR)

( * ) Notice: Subject to any disclaimer, the term of this patent is extended or adjusted under 35 U.S.C. 154(b) by 296 days.

(21) Appl. No.: 17/234,862

(22) Filed: Apr. 20, 2021

(65) Prior Publication Data

US 2021/0322803 A1 Oct. 21, 2021

(30) Foreign Application Priority Data

Apr. 20, 2020 (EP) ..... 20170451

(51) Int. Cl.
*A62B 23/02* (2006.01)
*A41D 13/11* (2006.01)
(Continued)

(52) U.S. Cl.
CPC ..... *A62B 23/025* (2013.01); *A41D 13/1161* (2013.01); *A62B 7/10* (2013.01); *A62B 18/084* (2013.01); *A41D 2500/20* (2013.01)

(58) Field of Classification Search
CPC ..... A62B 18/00; A62B 18/02; A62B 18/025; A62B 18/08; A62B 18/084; A62B 23/00–06; A62B 7/00; A62B 7/10; A41D 13/11–1192; A41D 2500/20; D03D 1/00; D03D 1/0035; D03D 13/00; D03D 13/004; D03D 13/008; D03D 13/25; D03D 13/56; D03D 13/587; D03D 13/67; D03D 15/00; D03D 15/20; D03D 15/242; D03D 15/25; D03D 15/50; D03D 15/56; D03D 15/587; D10B 2501/042; D10B 2505/04;
(Continued)

(56) References Cited

U.S. PATENT DOCUMENTS 10,808,338 B1 * 10/2020 Yidi ..... D03D 15/283
2021/0308497 A1 * 10/2021 Polignone ..... A62B 23/025

FOREIGN PATENT DOCUMENTS

CN 109463819 3/2019
DE 2020101910 4/2020
(Continued)

OTHER PUBLICATIONS

European Search Report issued by the EPO for corresponding EP application No. 21169302.3 dated Aug. 19, 2021.
(Continued)

*Primary Examiner* — Michelle J Lee

(57) ABSTRACT

A respiratory mask includes a mask fabric body made of a woven fabric having weft yarns and warp yarns, said fabric yarns comprising at least one yarn selected from yarns of a plastically bendable material and elastic yarns or threads.

11 Claims, 3 Drawing Sheets

(51) Int. Cl.

| | |
|---|---|
| ***A62B 18/02*** | (2006.01) |
| ***A62B 18/08*** | (2006.01) |
| ***A62B 7/10*** | (2006.01) |
| *D03D 1/00* | (2006.01) |
| *D03D 13/00* | (2006.01) |
| *D03D 15/25* | (2021.01) |
| *D03D 15/56* | (2021.01) |
| *D03D 15/587* | (2021.01) |
| *D03D 15/00* | (2021.01) |
| *D06C 7/00* | (2006.01) |

(58) Field of Classification Search
CPC ..... D10B 2509/00; D10B 2401/04; D10B 2401/041; D10B 2401/06; D10B 2401/062; D10B 2101/00; D10B 2101/20; D06C 7/00
See application file for complete search history.

(56) References Cited

FOREIGN PATENT DOCUMENTS

| | | |
|---|---|---|
| JP | 6147452 B1 * | 6/2017 |
| WO | 9710026 | 3/1997 |
| WO | 2012030798 | 3/2012 |

OTHER PUBLICATIONS

International Search Report issued by the EPO for corresponding International application PCT/EP2021/060163 dated Jul. 26, 2021.

* cited by examiner

RESPIRATORY MASK AND METHOD OF PRODUCTION

This application is claims priority to and the benefit of European Application No. 20170451.7 filed on Apr. 20, 2020 the content of which is incorporated herein by reference in its entirety.

FIELD OF THE INVENTION

The present invention relates to respiratory masks and to a method of their production. More specifically, the present invention relates to a protection mask to be worn on the face. The invention also relates to a method for the production of this mask.

STATE OF THE ART

Personal respiratory masks, also known as "face masks" or "filtering face masks", are protective devices used to protect the wearer's respiratory system from airborne particles. Facial masks are in fact worn over the nose and mouth of the user to protect him from unwanted material suspended in the air. In some embodiments (namely those without a valve that let breath exit the mask) the mask also acts as a filter to prevent or reduce the leakage of any particles suspended in the user's breath to protect other people from possible infections of the person wearing mask. Known masks are typically made of non-woven fabric in two forms: a cup-shaped shape or a flat shape in which the non-woven fabric is partially folded on itself to be able to adapt to the shape of the face when worn. One type of flat mask is known as a "surgical mask". Flat masks made of woven fabric are also known.

A mask requires the presence of straps or bands, preferably of elastic material, which generally are in the form of loops that pass around the user's ears or around the user's head to keep the mask in the desired position on the user's face. The straps or equivalent retaining means are typically made separately and are attached to the body of the mask, by means such as sewing, gluing, ultrasonic welding, stapling or other means commonly known to those skilled in the art. Protective devices are also known in which the retaining means are loops of elastic material attached to a folded portion of the mask body.

The production of flat masks of the so-called surgical type discussed above is normally carried out with automatic machines that carry out in line all or almost all the necessary operations, such as cutting and folding the portion of non-woven fabric, welding or otherwise constraining the elastic straps that hold the body of the mask on the user's face and attaching the metal strip to the top side of the mask.

A face mask also requires the presence of a strip of plastically bendable material, generally a metal strip, that is located at the upper edge of the mask, i.e. at the side of the mask that is transversally floating over the bridge of the nose of the user when the mask is worn. This so-called "nose clip" may actually be made of any material provided it can be easily bended in a shape fitting to the bridge of the nose of the user to improve the air tightness of the mask.

One problem with known non-woven masks is that they can normally only be used only once and that they are difficult to be sanitized. This problem results in an increase in costs each time the mask is replaced, and in an increase in the mass of special waste to be treated.

Woven fabric masks are known that can be washed or otherwise sanitized to be used several times. However, woven fabric masks are more expensive than the non-woven fabric masks.

SUMMARY OF THE INVENTION

An aim of the present invention is to solve the above discussed problems. More specifically, an object of the present invention is to provide a face protection mask which is made of woven fabric and that is at the same time inexpensive to manufacture. Another aim of the invention is to provide an inexpensive method of production of a protection mask in woven fabric.

These and other aims are reached by the present invention as described below.

In greater detail, the invention relates to a respiratory mask including a mask body, a strip of plastically bendable material and holding straps for holding the mask body to the face of the user, the mask body being made of a woven fabric having weft yarns and warp yarns, characterized in that at least one of said strip of plastically bendable material and holding straps comprises at least one yarn woven with said mask body fabric.

In an embodiment, the strip of bendable material is made of at least one, preferably a plurality of, metallic wire, a metallic filament yarn or metallic staple yarn that are woven into the body of the fabric in the weaving step of the mask production method. Suitable metallic yarns are copper filaments or steel filaments e.g. having diameter of 0.06 mm; in an embodiment of the yarn the metal wire is coated with a resin, e.g. an epoxy resin, to prevent metal oxidation and metal conductivity. The number of yarns or wires can be between 1 to 25, preferably 1 to 10. The fabric weave can be any one of plain, twill or sateen. The metallic wires extend in the fabric along the entire side of the mask from one edge of the mask body to the other edge.

In an embodiment, the holding straps are made of at least one elastic thread woven into the body of the fabric during the weaving step. Suitable elastic threads include braiding yarns, woven yarns, knitting yarns or a single elastic yarn. A suitable elastic thread has a composition of 85% elastane and 15% nylon, a diameter of 3 mm and a linear mass of 0.8 grams/meter.

According to an embodiment, the elastic thread is tightly woven, e.g. with a 1/1 or 2/1 pattern at the region of the fabric that is close to the mask sides; this weaving pattern secures the thread to the fabric. To provide for the strap or band required, the elastic thread has at least one long float over warp (or weft) yarns; several long floats may be provided, with holding point made e.g. by one or two weft or warp yarns that float over the elastic thread to hold it to the fabric portion. In an embodiment the elastic thread floats over about e.g. 3-5 cm of fabric before being held down by said weft or warp yarns; another float is provided with another holding point and so on along the fabric. Before using the mask, these holding yarns can be broken to detach the central part of the elastic thread from the fabric body and provide a loop of the required length to be passed over the ears or over the head of the user.

Preferably the metallic yarns and the elastic threads are both woven in the fabric. In an embodiment, metallic and elastic yarns are woven into the fabric as warp yarns. They may be both weft yarns or both warp yarns; in an embodiment, at least the elastic thread is woven as a warp yarn. Generally, if the elastic thread is to be passed over the ears, it is woven perpendicular to the metallic yarns; if the elastic thread is to be passed over the head, it is woven alongside the metallic yarns.

According to other embodiments, the sides of the mask may be provided with fusion yarns, i.e. yarns that have the ability to become softened, flattened or compressed and to hold together the fabric yarns. Suitable fusion yarns can soften and be flattened or compressed under heat, pressure or by a chemical treatment. In addition, gluing and waxing can be applied to reduce hairiness at the sides of the mask fabric. Suitable fusion yarns are low melting nylon commercially available, e.g. from Coats under the code Fusion-FTL2180. These yarns have a melting temperature of 85° C.; upon treatment with e.g. hot steam the polymer softens and melts to incorporate in the polymer the loose ends of the yarns and prevent fabric fraying.

The body of the mask is made of a woven fabric. The fabric yarns can include man made or natural fiber or a blend of them. The fabric may include elastic yarns in warp or weft or both directions; preferably the weft yarns are elastic yarns and the warp yarns are non-elastic yarns, e.g. cotton yarns or polyester yarns. In a preferred embodiment the fabric includes weft yarns having different elasticity in different regions of the mask body, so as to enable the face mask to adapt and fit to the wearer's face. The weft yarns are woven according to a fabric construction to improve fitting performance of the woven fabric. Exemplary suitable fabric weaves can be any one of plain, twill or sateen.

In embodiments, the cotton inelastic warp yarns have a count of 30 to 45 Ne, the elastic weft yarns have a count of 25 to 40 Ne. A typical fabric composition is 98% cotton and 1.68% elastan, the remaining part including metal yarns and fusion yarns, if present.

The invention woven face mask is manufactured by known weaving machines, preferably jacquard and dobby machines. An object of the present invention is a mask production method wherein a mask fabric is woven from warp and weft yarns, characterized in that said warp or weft yarns include at least one of: a yarn of plastically bendable (malleable) material and a yarn including an elastic thread that are woven with the fabric yarns to provide at least one of: a strip of plastically bendable material for a nose clip and holding straps for holding the mask body to the face of the user.

In an embodiment, the method includes the steps of providing a face mask design; providing a plurality of fabric yarns to produce a woven fabric; providing a plurality of metallic yarn, elastic threads to be introduced into the weaving machine and woven with said fabric yarns in a single production process.

The fabric as obtained on the loom includes a plurality of facemasks that are adjacent to each other in the fabric; they are thus produced together in an amount that depends on the width of the loom in the weaving machine and on the dimensions of the mask. After the required finishing steps the fabric is cut into individual masks, each mask being already provided with at least a "nose clip" or with the elastic straps, or preferably with both features.

According to an embodiment, fusion yarns are woven at the edges of the mask body with the fabric yarns and the technical yarns (i.e. metallic yarns and/or elastic thread) to provide a finishing of the mask by heat treatment of the fabric. Thus, the invention method may include a heat treatment step such as e.g. hot steam treatment of the fabric.

The fabric is then cut to provide single masks that advantageously are provided with all required items, including elastic straps and a malleable (plastically bendable) material for a nose clip. Subsequent finishing steps such as trimming, folding, or gluing may be used to give the final form of the mask.

BRIEF DESCRIPTION OF THE DRAWINGS

The invention will now be disclosed with reference to the following schematic and exemplary, non-limiting drawings in which.

DISCLOSURE OF PREFERRED EMBODIMENTS

Figure 1:
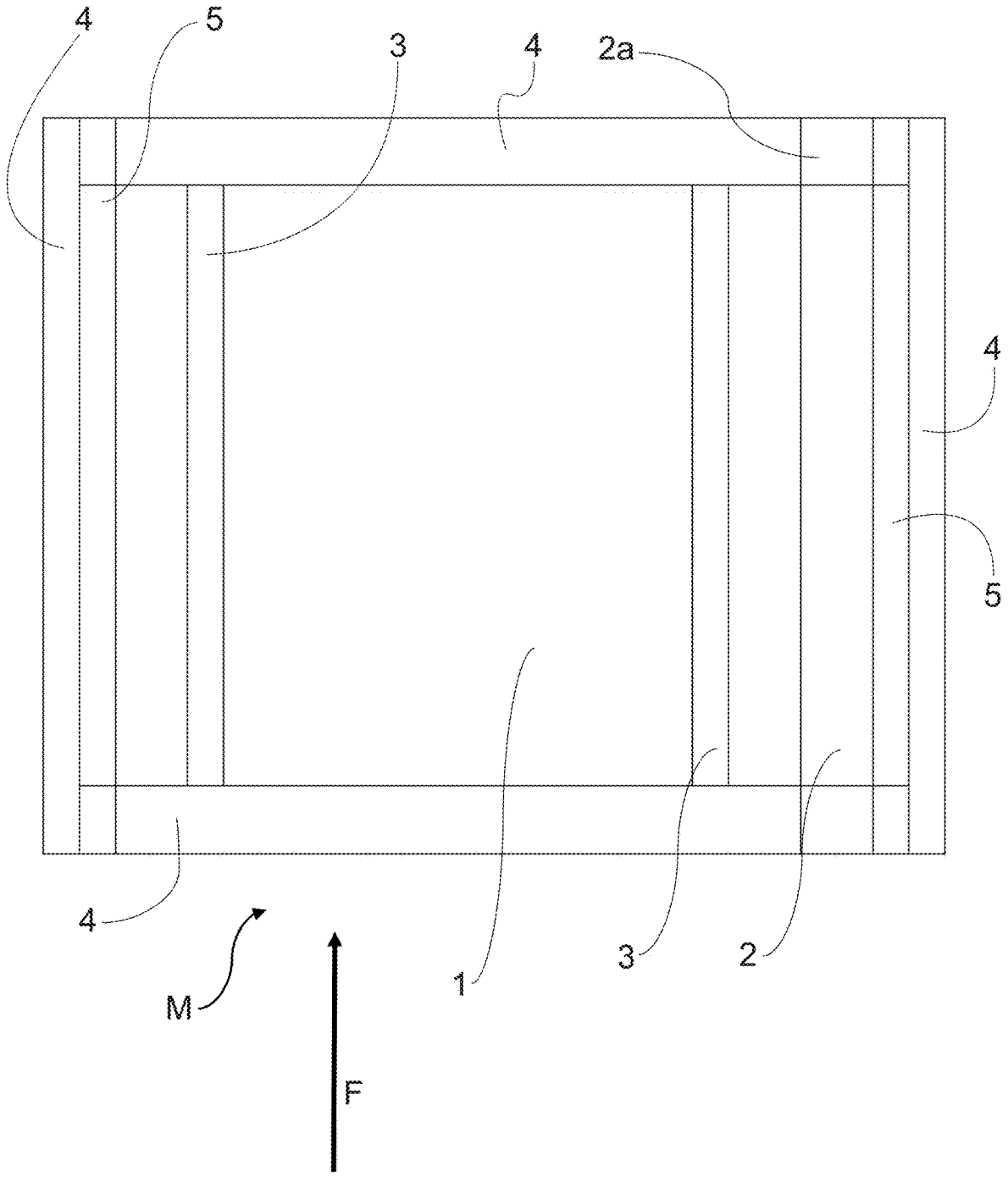
FIG. 1 is a schematic view of a mask according to the invention.

With reference to FIG. 1, the mask M includes a mask body made of a woven fabric 1 including warp yarns and weft yarns; in FIG. 1 the warp yarns extend vertically, i.e. parallel to arrow F that shows the machine direction or longitudinal direction of the fabric. Mask M is obtainable from a woven fabric comprising a plurality of adjacent masks as above discussed.

Woven with the fabric yarns are also present further yarns that provide at least one of a strip 2 of plastically bendable material forming a so-called "nose clip" and holding straps 3, preferably elastic holding straps that pass around the head of the user when the mask is used. According to the invention, the yarns that form strip 2 and strap 3 are woven with the other fabric yarns into the fabric of the mask during the weaving step. Said yarns define respective portions, or regions, of the mask.

The yarns that form strip 2 of bendable material for the nose clip may comprise a plurality of metallic wires, such as a metallic filament yarn or metallic staple yarn that are woven into the body of the fabric in the weaving step of the mask production method. Suitable metallic yarns are copper filaments or steel filaments having diameter of 0.06 mm, to prevent metal oxidation the metal wire is preferably coated with a resin, such as an epoxy resin. A suitable diameter is 0.05-0.10 mm, preferably 0.06 mm including coating layer. The number of metal yarns or wires can be between 1 to 25, preferably 1 to 10. As visible in the figures, the strip 2 of metallic wires extend in the fabric along the entire side of the mask from one edge 8 of the mask body to the other edge 9; similarly, the elastic thread will extend through the entire body of the mask.

Holding straps 3 are made of at least one elastic thread 6 (see FIG. 3) woven into the body of the fabric during the weaving step. In an embodiment, thread 6 is a single elastic yarn having a composition of 85% elastane and 15% nylon, a diameter of 3 mm and a linear mass of 0.8 grams/meter.

Figure 2:
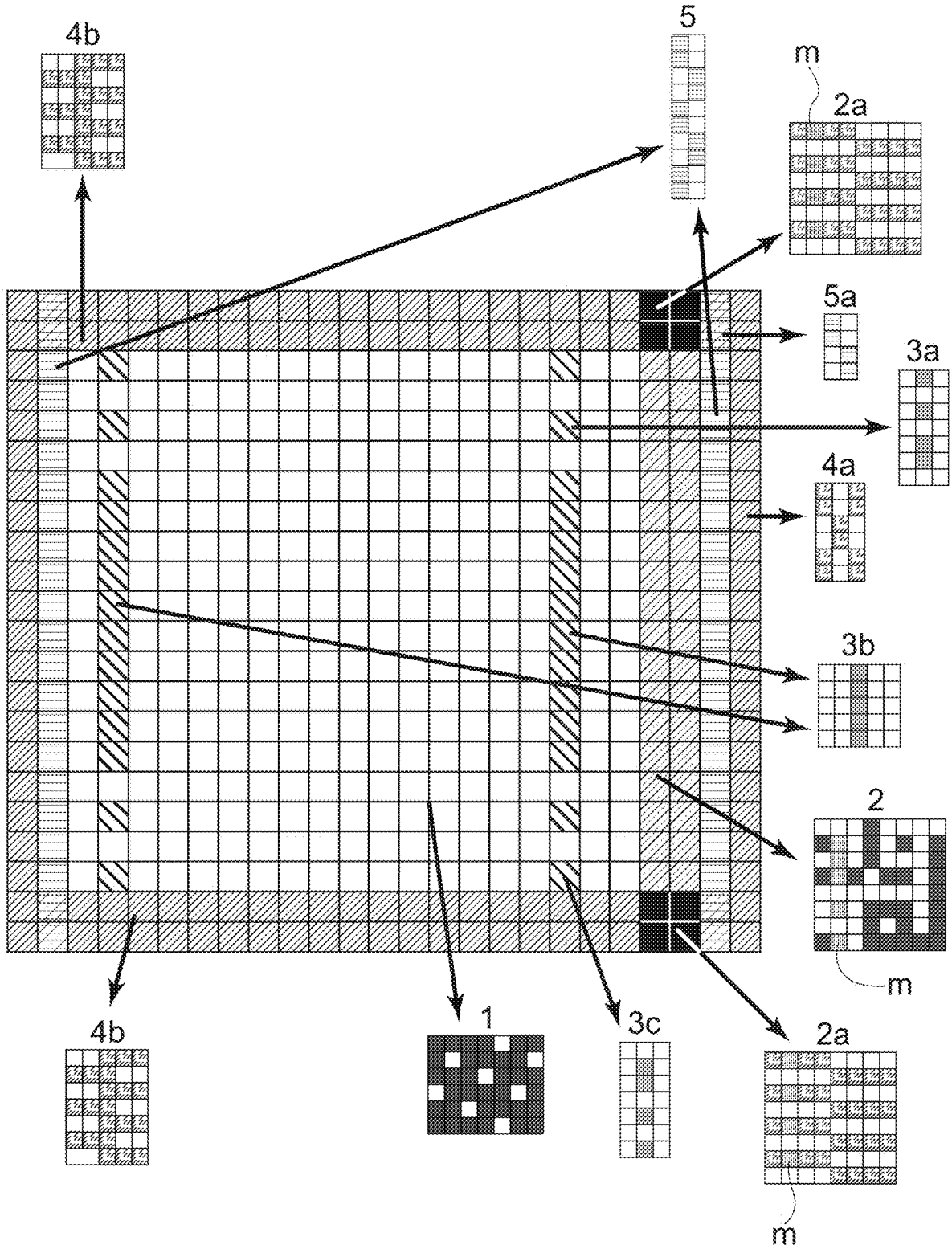
FIG. 2 is a detailed view of the mask according to FIG. 1 showing enlarged details of possible weaving patterns.
Figure 5:
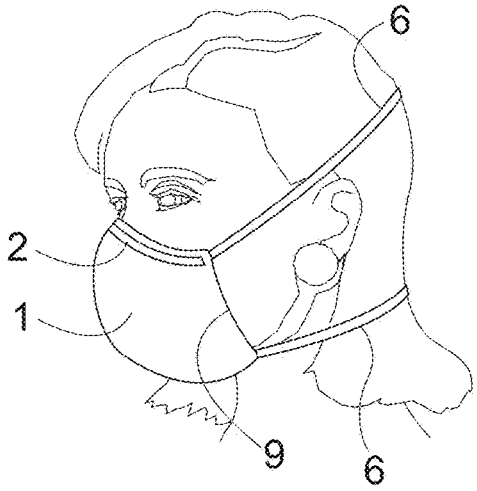
FIG. 5 is a schematic view of the mask in use.

The weaving pattern of thread 6 is such that at the ends 10 and 11 (FIG. 3) of elastic thread 6, i.e. at the area of the fabric that is close to sides 8 and 9 of the mask, the elastic thread is tightly woven, e.g. with a 1/1 or 2/1 pattern. To provide for the strap or band required, the elastic thread has at least one long float under warp (or weft) yarns. The embodiment shown in FIG. 2 is provided with one long float; in FIG. 3 a thread 3 with several long floats is shown. In this embodiment thread 3 is kept adherent to the body of fabric 1 by means of several holding points 12 made by one weft yarn that floats over the elastic thread to hold it to the fabric portion at said holding point. The length L of thread 6 under portions, i.e. the length L of the portion of yarn 6 between two adjacent holding points 12, may be about e.g. 3-5 cm of fabric. As previously discussed, before using the mask, weft yarns at holding points 12 are broken to detach the elastic yarn from the fabric body and to provide a loop of the required length to be passed over the head of the user, see FIG. 5.

In the shown embodiment, elastic yarns 6 are woven into the fabric as warp yarns to provide an elastic strap or band to be passed over the head; in this embodiment, one of the elastic yarns 6 is woven parallel to the metallic yarns of strip 2. The face of the mask where the under portions of the elastic thread are located is the side of the mask that will be in contact with the face of the user (see FIG. 5).

Advantageously, fusion yarns are provided along the sides of the mask in the peripheral, i.e. in the contour portion 4 of the mask (see FIGS. 1 and 2); fusion yarns are yarns that have the ability of becoming softened and to be flattened or compressed to hold together the fabric yarns at the edge of the fabric to prevent loose ends being visible. Suitable fusion yarns can be softened and flattened or compressed under heat, pressure or by a chemical treatment. Suitable fusion yarns are low melting nylon commercially available, e.g. from Coats under the code Fusion-FTL2 180. These yarns have a melting temperature of 85° C.

The mask construction also preferably includes two warp-wise portions, or regions 5, of so called limiting yarns, e.g. polyester yarns that define the body of the mask between the mask body yarns or the metallic or elastic yarns and the peripherally located fusion yarns of mask region 4.

The body 1 of the mask is made of a woven fabric from yarns that may include man made or natural fibers or a blend of them. The fabric may include elastic yarns in warp or weft or both directions; according to one embodiment the weft yarns are elastic yarns and the warp yarns are non-elastic yarns, e.g. cotton yarns or polyester yarns. Preferably the weft yarns have different elasticity in different regions of the mask body; namely, the weft yarns closer to sides 8 and 9 have less elongation than the yarns in the central area of the mask, so as to enable the face mask to adapt and fit to the wearer's face. Suitable fabric weaves for the mask body 1 can be any one of plain, twill or sateen.

Typically, the cotton inelastic warp yarns have a count of 30 to 45 Ne, the elastic weft yarns have a count of 25 to 40 Ne. A typical fabric composition is 98% cotton and 1.68% elastan, the remaining part including metal yarns and fusion yarns, if present. The count and the warp and weft densities (after washing) are selected to provide the fabric 1 with the required filtering properties; said filtering properties may be assessed according to standard EN 14683:2019.

The schematic and merely exemplary weave report of FIG. 2 shows the above mentioned regions of the mask fabric; for each region of the fabric an enlarged sample of construction is shown, to provide details of a possible embodiment of the invention. In a mask of the present invention, each of the portions shown in FIG. 1 may be woven according to patterns different from the ones shown in FIG. 2; in other words, the exemplified patterns do not necessarily have to be present all together as shown in FIG. 2.

In the following exemplary description, the mask body portion 1 is woven by cotton weft yarn and cotton warp yarn. The weft yarn is shown in FIG. 2 with white whereas the warp yarn is shown with black in the weaving pattern.

Figure 3:
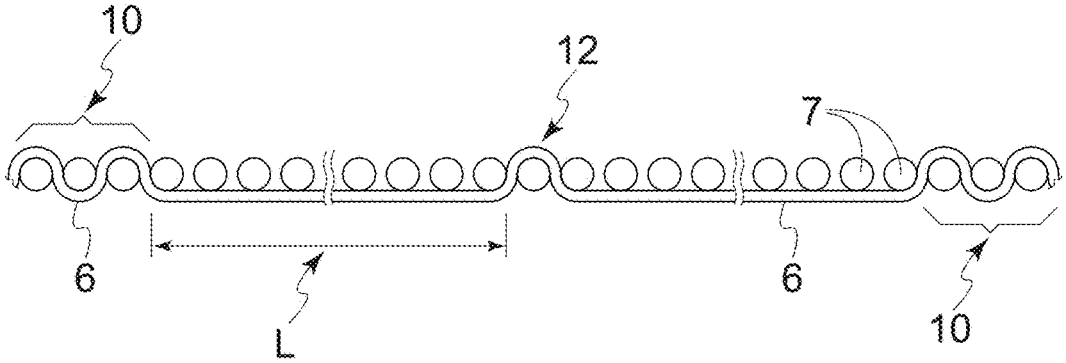
FIG. 3 is a schematic view of a section warpwise of the mask of the invention.
Figure 4:
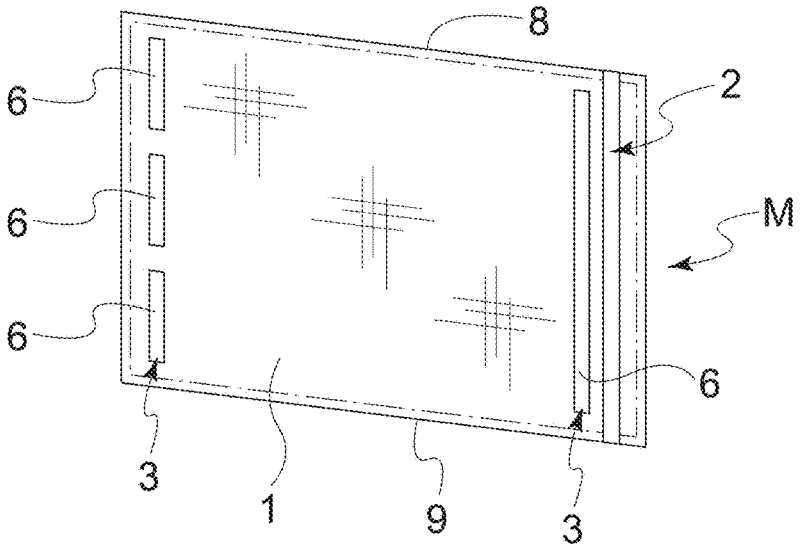
FIG. 4 is a schematic view of the back side of a mask of the invention.

Portion 4 of the mask comprises fusion yarns. In an embodiment, the part of portion 4 that extends in warp direction, i.e. parallel to arrow F, is referred to with numeral reference 4*a* and has a weaving scheme where the weft yarn is a cotton yarn (shown with white) and the warp yarn is a fusion yarn (shown with a grey pattern). In the part of region 4 extending in the weft direction (shown with reference 4*b*), the fusion yarns are weft yarns shown in white and the warp yarns shown in grey pattern are cotton yarns. Region 3 shown in FIG. 2 is woven by a cotton weft yarn shown with white in the pattern and an elastic warp yarn shown with grey. The elastic yarn is located on the back side of the fabric as shown in FIG. 3 and FIG. 4. Examples of weaving reports of top part, middle part and bottom part of region 3 are shown in FIGS. 3*a*, 3*b* and 3*c*, respectively.

In mask portion 5, the weft yarn is a cotton yarn shown with white in the weaving pattern whereas the warp yarns are "limiting" yarns (e.g. in polyester) and are shown with grey pattern. In portion 5*a* where regions 4 and 5 overlap, the weft yarns are fusion yarns shown in white and the warp yarns are polyester yarns as shown in region 5.

Mask portions 2 and 2*a* comprise at least one metallic warp yarn (referred to with reference m), white weft yarns and black warp yarns. The overlapping area of regions 2 and 4 is identified with reference number 2*a*. For example portion 2*a* shows a possible weave of the overlapping regions 2 and 4. In detail, the weaving pattern of portion 2 includes a cotton weft yarn (in white) and two different warp yarns formed by a cotton yarn (in black) and a metallic warp yarn (m). The weaving pattern of region 2*a* is formed by a fusion weft yarn (white) and by two different warp yarns which are a cotton yarn (in grey) and the metallic yarn (m).

The width of each region is designed according to the specific requirement of the mask, which means that the number of the weaving patterns shown in FIG. 2 may be chosen to provide the best advantageous effects of the present invention. For example, weftwise fusion region 4*b* may include seven weft yarns as shown in 4*b* or might include more or less weft yarns.

The method of producing the above discussed mask provides weaving warp and weft yarns, said warp or weft yarns including at least one of a yarn of plastically bendable yarns and at least one yarn including an elastic thread 6. Said yarns are woven with the fabric yarns to provide at least one of a strip 2 of plastically bendable (malleable) material and a pair of holding straps 3 for holding the mask body to the face of the user.

The method may also include the steps of providing a facemask design; providing a plurality of fabric yarns to produce a woven fabric; providing a plurality of metallic yarn, elastic threads to be introduced into the weaving machine and woven with said fabric yarns in a single production process.

The fabric on the loom is made to include a plurality of face masks that are all produced together depending on the width of the loom in the weaving machine and on the dimensions of the mask.

Fusion yarns are woven with the fabric yarns and the technical yarns (metallic yarns and/or elastic thread) to provide peripheral region 4 along the sides of the mask fabric 1. The fabric is subjected to a finishing step by a heat treatment step such as e.g. hot steam treatment of the fabric. In this step the low melting fusion yarns soften or melt to a sufficient degree to hold together the ends of the yarns and avoid fabric fraying. Surface treatment of the fabric may be carried out.

The fabric is then cut to provide single masks that comprise all required items, including elastic straps and a malleable (plastically bendable) material for a nose clip. Subsequent finishing steps such as trimming, folding, or gluing may be used to give the final form of the mask.

The invention claimed is:

1. A respiratory mask including:

a mask fabric body (1);

a strip of plastically bendable material (2) at a top of the mask fabric body forming a nose clip;

and holding straps (3) for holding the mask fabric body to a face of a user, the holding straps extending across the mask fabric body such that they are parallel to the strip of plastically bendable material;

the mask fabric body being made of a woven fabric having weft yarns and warp yarns;

wherein said strip of plastically bendable material is made of at least one metallic filament yarn (m), and said holding straps are made of at least one elastic yarn (6), wherein said metallic and elastic yarns are woven into the mask fabric body as warp yarns.

2. A method of producing the respiratory mask according to claim 1 comprising the steps of:

providing a plurality of fabric yarns to produce the woven fabric; and weaving the warp and weft yarns using the plurality of fabric yarns, said warp and weft yarns including the at least one metallic filament yarn (m) and the at least one elastic yarn (6) to provide the strip (2) of plastically bendable material for the nose clip and the holding straps (3) for holding the mask fabric body to the face of the user.

3. The method according to claim 2 wherein the woven fabric is produced on a loom and includes a plurality of masks that are cut after the woven fabric is removed from the loom and has gone through finishing steps.

4. The method according to claim 2, wherein fusion yarns are woven with the plurality of fabric yarns to provide fusion regions (4) along sides of the mask fabric body (1).

5. The method according to claim 2, further including a heat treatment step whereby low melting fusion yarns soften or melt to a sufficient degree to hold together ends of the plurality of fabric yarns.

6. The method according to claim 2, wherein said mask further comprises several long floats of said at least one elastic yarn on one side of the mask and several holding points (12) made by at least one weft or warp yarn floating over said at least one elastic yarn (6) to hold it to the mask fabric body (1), the method including the step of breaking said holding points (12) to provide a long loop of the at least one elastic yarn (6).

7. The mask according to claim 1, wherein said at least one elastic yarn is woven with a 1/1 or 2/1 pattern at a region of the mask fabric body that is close to sides (8, 9) of the mask, said at least one elastic yarn (6) having at least one long float over warp or weft yarns, in a central region of the mask fabric body (1).

8. The mask according to claim 7, wherein said central region of the mask further comprises holding points (12) made by at least one weft or warp yarn floating over said at least one elastic yarn (6) to hold it to the mask fabric body (1).

9. The mask according to claim 7, said at least one elastic yarn (6) having several long floats over warp or weft yarns in the central region of the mask fabric body (1).

10. The mask according to claim 1, wherein upper and lower sides (4) of the mask are provided with fusion yarns.

11. The mask according to claim 1, wherein said at least one metallic filament yarn (m) is coated with a resin.

* * * * *